US011454416B2

(12) United States Patent
Yan et al.

(10) Patent No.: US 11,454,416 B2
(45) Date of Patent: Sep. 27, 2022

(54) MIDDLE AIR DUCT OF AIR CONDITIONER AND AIR CONDITIONER

(71) Applicant: GD MIDEA AIR-CONDITIONING EQUIPMENT CO., LTD., Guangdong (CN)

(72) Inventors: Changlin Yan, Guangdong (CN); Liangrui Chen, Guangdong (CN); Hongliang Yuan, Guangdong (CN); Zhiqiang Liu, Guangdong (CN); Xianyou Mao, Guangdong (CN); Daijie Peng, Guangdong (CN); Zhiqiang Yang, Guangdong (CN); Liang Shen, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 479 days.

(21) Appl. No.: 16/497,099

(22) PCT Filed: Jun. 28, 2018

(86) PCT No.: PCT/CN2018/093472

§ 371 (c)(1),
(2) Date: Sep. 24, 2019

(87) PCT Pub. No.: WO2019/169812

PCT Pub. Date: Sep. 12, 2019

(65) Prior Publication Data

US 2020/0200427 A1 Jun. 25, 2020

(30) Foreign Application Priority Data

Mar. 7, 2018 (CN) ..... 201810188299.6
Mar. 7, 2018 (CN) ..... 201820318969.7

(51) Int. Cl.
*F24F 13/02* (2006.01)

(52) U.S. Cl.
CPC ..... *F24F 13/0209* (2013.01); *F24F 13/0245* (2013.01)

(58) Field of Classification Search
CPC .... F24F 13/0209; F24F 13/0254; F24F 13/18; F24F 13/062

(Continued)

(56) References Cited

U.S. PATENT DOCUMENTS 2,114,027 A * 4/1938 McDonald ..... A24F 19/0071 285/424
2,153,576 A * 4/1939 Kurth ..... F24F 13/062 415/157

(Continued)

FOREIGN PATENT DOCUMENTS

CN 202692257 U 1/2013
CN 103453643 A 12/2013

(Continued)

OTHER PUBLICATIONS

Second Office Action dated Feb. 3, 2020 received in Chinese Patent Application No. CN 201810188299.6 together with an English language translation.

(Continued)

*Primary Examiner* — David Bochna
(74) *Attorney, Agent, or Firm* — Scully Scott Murphy & Presser

(57) ABSTRACT

An air duct having first to third air ducts, each of the first to third air ducts has a duct structure having a first end and a second end, the duct structure of the each of the first to third air ducts are separable from each other, a cross sectional area of the first end is greater than a cross sectional area of the second end, a plurality of cross sectional areas between the first end and the second end decrease progressively from the first end to the second end, and the first to third air ducts are (Continued)

communicated successively in a direction such that the second end of the duct structure of the third air duct is arranged closer to the second end of the duct structure of the first air duct and further from the first end of the duct structure of the first air duct.

18 Claims, 3 Drawing Sheets

(58) Field of Classification Search
USPC ..... 285/424
See application file for complete search history.

(56) References Cited

U.S. PATENT DOCUMENTS

| | | | | | |
|---|---|---|---|---|---|
| 2,319,518 | A * | 5/1943 | Rau | F16L 23/08 285/424 |
| 2,369,119 | A * | 2/1945 | Dauphinee | F24F 13/062 454/302 |
| 2,684,024 | A * | 7/1954 | Kurth | F24F 13/062 454/261 |
| 2013/0331022 | A1* | 12/2013 | Sandman | F24F 13/0209 285/364 |
| 2017/0254557 | A1* | 9/2017 | Chiu | F24F 13/0209 |

FOREIGN PATENT DOCUMENTS

| | | | |
|---|---|---|---|
| CN | 103453643 | B | 9/2015 |
| CN | 105156344 | A | 12/2015 |
| CN | 105650743 | A | 6/2016 |
| CN | 205743139 | U | 11/2016 |
| CN | 106196355 | A | 12/2016 |
| CN | 106440300 | A | 2/2017 |
| CN | 107328065 | A | 11/2017 |
| EP | 2 607 807 | A1 | 6/2013 |
| EP | 2 716 915 | B1 | 3/2015 |
| EP | 3 006 838 | A1 | 4/2016 |
| EP | 3 006 855 | A1 | 4/2016 |
| HK | 1170295 | A1 | 12/2014 |
| JP | H06-073640 | U | 10/1994 |
| JP | H07-217979 | A | 8/1995 |
| JP | H07-260189 | A | 10/1995 |
| JP | 2008-151413 | A | 7/2008 |
| JP | 2014-035107 | A | 2/2014 |
| KR | 10-1998-0031023 | A | 7/1998 |
| KR | 10-2005-0102906 | A | 10/2005 |
| KR | 10-2013-0071150 | A | 6/2013 |

OTHER PUBLICATIONS

Extended European Search Report dated Mar. 17, 2021 received in European Patent Application No. EP 18909012.9.

International Search Report dated Nov. 16, 2018 issued in PCT/CN2018/093472.

Notice of Reasons for Refusal dated Nov. 10, 2020 received in Japanese Patent Application No. JP 2019-552266 together with an English language translation.

International Search Report dated Nov. 16, 2018 received in International Application No. PCT/CN2018/093472.

First Office Action dated Apr. 19, 2019 received in Chinese Patent Application No. CN 201810188299.6 together with an English language translation.

Notification of Reason for Refusal dated Mar. 16, 2021 received in Korean Patent Application No. KR 10-2019-7029801 together with an English language translation.

* cited by examiner

MIDDLE AIR DUCT OF AIR CONDITIONER AND AIR CONDITIONER

CROSS-REFERENCE TO RELATED APPLICATIONS

The subject application is a national stage entry of PCT International Application No. PCT/CN2018/093472, filed on Jun. 28, 2018, which claims priority to Chinese Patent Application No. 201810188299.6, filed on Mar. 7, 2018, and Chinese Patent Application No. 201820318969.7, filed on Mar. 7, 2018. The entire disclosure of each of PCT International Application No. PCT/CN2018/093472, Chinese Patent Application No. 201810188299.6 and Chinese Patent Application No. 201820318969.7 is incorporated by reference for all purposes. No new matter has been introduced.

FIELD

The present invention relates to the technical field of air conditioners, and particularly to a middle air duct of an air conditioner and an air conditioner having the middle air duct.

BACKGROUND

In related art, some vertical air conditioners integrate purification function, for example, a vertical air conditioner is divided into an upper blower portion, a middle air duct support and a lower air inlet portion, the lower air inlet portion has purification function, a middle air duct of the middle air duct support is communicated with the upper blower portion and the lower air inlet portion. However, the middle air duct has a relatively complex structure, and poor gas fluidity, therefore, it is not easy to be manufactured.

SUMMARY

The present invention aims at solving at least one of the technical problems in the prior art. For this purpose, the present invention provides a middle air duct of an air conditioner, and the middle air duct has a simple structure and good gas fluidity.

The present invention further provides an air conditioner.

A middle air duct of an air conditioner according to the present invention includes: a first air duct, a second air duct and a third air duct communicated successively, the first air duct, the second air duct and the third air duct are structures with gradual-change cross sectional areas, the cross sectional area of the first air duct gradually changes opposite to that of the third air duct, moreover the cross sectional area of the first air duct and the third air duct decreases progressively in a mutually approaching direction.

The middle air duct of the air conditioner according to the present invention, the first air duct, the second air duct and the third air duct are communicated successively in the direction of air flow, it is easy to mold air ducts by a way of in-sequence split units, and furthermore, the way of split units reassembly after molding may lower the manufacturing difficulty of middle air ducts. Moreover, during flow process, the flow area of the air in the middle air duct will respectively decrease and increase progressively in the inlet and outlet, such a configuration may be beneficial to improving fluidity of the air in the middle air duct, beneficial for the air to flow into/out of the middle air duct, thus enhancing the flowing property of the air in the middle air duct.

In some examples of the present invention, the cross-sectional area of the second air duct gradually changes the same as that of the first air duct.

In some examples of the present invention, a first end of the second air duct is provided with one kind of positioning columns and positioning holes, a first end of the first air duct is provided with another kind of the positioning columns and the positioning holes, and the positioning columns is suitable for extending into the positioning holes.

In some examples of the present invention, mounting columns are further disposed on the first end of the second air duct, fixing sleeves are disposed on the first end of the first air duct, and the partial mounting columns stretch into the fixing sleeves and suitable for being fixed with fasteners.

In some examples of the present invention, second mounting plates are further disposed on a second end of the second air duct; third mounting plates are disposed on a first end of the third air duct and the second mounting plates are fixed with the third mounting plates.

In some examples of the present invention, there are a plurality of second mounting plates which respectively bulge inward along circumference of the second end of the second air duct, there are a plurality of third mounting plates which respectively bulge inward along circumference of the first end of the third air duct.

In some examples of the present invention, the second mounting plates and the third mounting plates are provided with mounting holes for fasteners to pass through successively.

In some examples of the present invention, positioning holes are arranged on at least one of the second mounting plates; positioning columns are arranged on at least one of the third mounting plates and the positioning columns are suitable for stretching into the positioning holes.

In some examples of the present invention, the first air duct, the second air duct and the third air duct are cast aluminum.

An air conditioner according to the present invention includes a middle air duct of the air conditioner.

Additional aspects and advantages of the present invention will be given in the following description, some of which will be apparent from the following description or be appreciated from practices of the present invention.

BRIEF DESCRIPTION OF THE DRAWINGS

The above and/or additional aspects and advantages of the present invention will be apparent and easily understood in the description of embodiments with reference to the following drawings, where.

Figure 1:
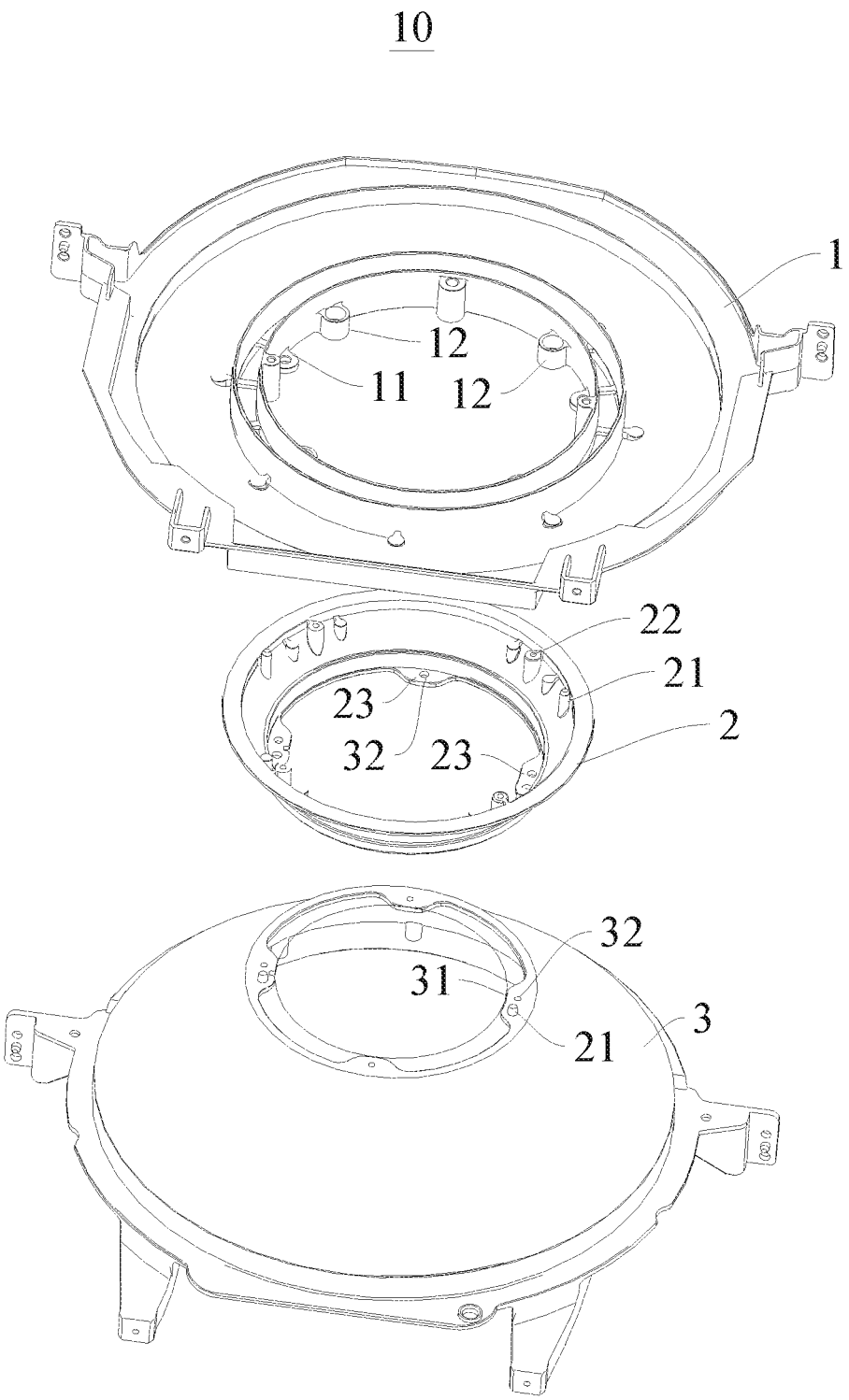
FIG. 1 is an explosive view of a middle air duct of an air conditioner according to embodiments of the present invention.

Reference numerals: middle air duct 10; first air duct 1; positioning holes 11; fixing sleeve 12; second air duct 2; positioning columns 21; mounting columns 22; second mounting plate 23; third air duct 3; third mounting plate 31; mounting holes 32.

DETAILED DESCRIPTION

The embodiments of the present invention are described in detail below, examples of the embodiments are shown in the drawings, same or similar numerals throughout denote same or similar elements or the elements having same or similar functions. The following embodiments described with reference to the drawings are illustrative and only used to explain the present invention, but may not be interpreted as the restrictions of the present invention.

In the description of the present invention, it will be appreciated that terms "center", "longitudinal", "lateral", "length", "width", "thickness", "upper", "lower", "front", "back", "left", "right", vertical", "horizontal", "top", "bottom", "inside", "outside", "clockwise", "anticlockwise", "axial", "radial", "circumferential" and other indicative directional or positional relation are the directional or positional relation based on the drawings, which is only intended to describe the present invention and simplify the description for convenience, but not to denote or hint that the indicated device or element must possess a specific direction, be constructed and operated in a specific direction, therefore, it should not be construed to limit the present invention. In addition, the features defining "first" and "second" may explicitly denote or impliedly include one or more of these features. In the description of the present invention, unless otherwise specified, "a plurality of" means two or more.

In the description of the present invention, it should be noted that unless otherwise stipulated and defined explicitly, terms "mount", "link", "connect" should be regarded as general understanding, e.g., permanent connection, detachable connection, or integrated connection are available; both mechanical connection and electric connection are also available; direct link, indirect link by media, or inner communication between two element are available. Those ordinary skilled in the art may understand the specific meanings of the above terms in the present invention according to particular situations.

A middle air duct 10 of an air conditioner according to embodiments of the present invention will be described in detail with reference to the drawings hereafter.

As shown in FIG. 1-FIG. 4, the middle air duct 10 of the air conditioner according to embodiments of the present invention may include: a first air duct 1, a second air duct 2 and a third air duct 3 communicated successively, in other words, the first air duct 1, the second air duct 2 and the third air duct 3 are communicated successively in the direction of air flow, it is easy to mold air ducts by way of in-sequence split units, and furthermore, by way of split units reassembly after molding may lower the level of difficulty in the manufacture of the middle air duct 10.

The first air duct 1, the second air duct 2 and the third air duct 3 are structures with gradual-change cross sectional areas. The cross sectional area of the first air duct 1 gradually changes opposite to that of the third air duct 3, moreover the cross sectional area of the first air duct 1 and the third air duct 3 decreases progressively in a mutually approaching direction. That is to say, during flow process, the flow area of the air in the middle air duct 10 will respectively decrease and increase progressively in the inlet and outlet, such a configuration may be beneficial to improving fluidity of the air in the middle air duct 10, beneficial for the air to flow into/out of the middle air duct 10, thus enhancing the gas flowing property of the middle air duct 10.

Further, as shown in FIGS. 1-4, the cross-sectional area of the second air duct 2 gradually changes the same as that of the first air duct 1. In other words, there are only two gradual change modes of the cross sectional area. One is a combined gradual change mode of the first air duct 1 and the second air duct 2, another one is a gradual change mode of the third air duct 3. The middle air duct 10 configured in such a way may make the air achieving better fluidity therein, and moreover may be beneficial to molding the second air duct 2.

Figure 2:
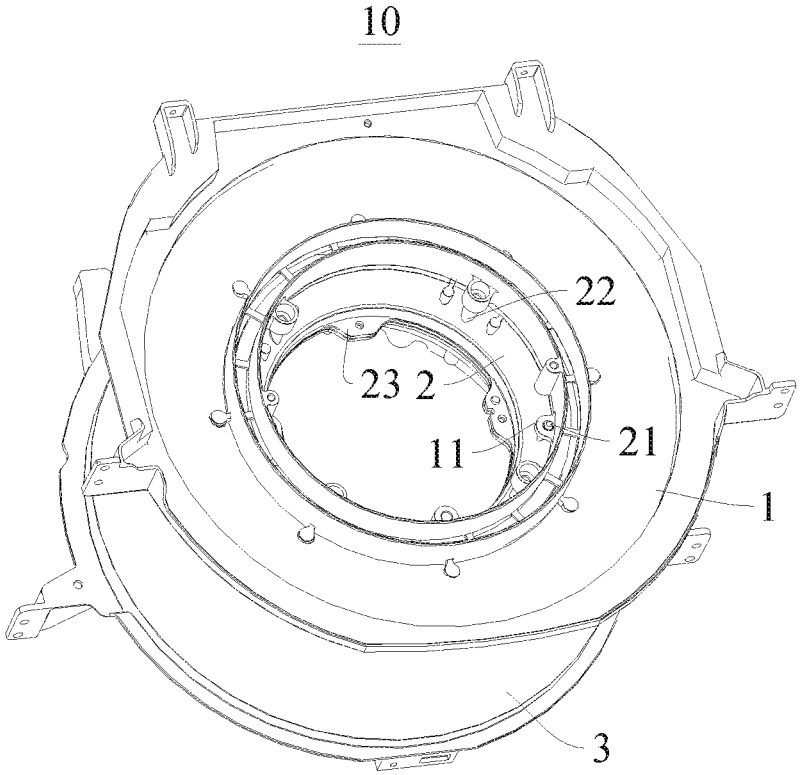
FIG. 2 and FIG. 3 are perspective views respectively showing the middle air duct of the air conditioner according to embodiments of the present invention from different angles of view.

According to an optional embodiment of the present invention, as shown in FIG. 1 and FIG. 2, a first end of the second air duct 2 is provided with one kind of positioning columns 21 and positioning holes 11. A first end of the first air duct 1 is provided with another kind of the positioning columns 21 and the positioning holes 11, and the positioning columns 21 are suitable for extending into the positioning holes 11. In other words, the positioning holes 11 are disposed on the first end of the first air duct 1 when the positioning columns 21 are disposed on the first end of the second air duct 2; the positioning columns 21 are disposed on the first end of the first air duct 1 when the positioning holes 11 are disposed on the first end of the second air duct 2. The positioning columns 21 and positioning holes 11 may play a pre-positioning role, thus reducing the mounting difficulty of the first air duct 1 and second air duct 2. There are a plurality of positioning columns 21, the plurality of positioning columns 21 are spaced circumferentially on the first end of the second air duct 2, and there are a plurality of positioning holes 11, the plurality of positioning holes 11 are spaced circumferentially on the first end of the first air duct 1, the plurality of positioning columns 21 correspond to the plurality of positioning holes 11 one by one. The first end of the first air duct 1 and the first end of the second air duct 2 approach with each other.

Further, as shown in FIG. 1 and FIG. 2, mounting columns 22 are disposed on the first end of the second air duct 2, fixing sleeves 12 are disposed on the first end of the first air duct 1, and a part of the mounting columns 22 stretch into the fixing sleeves 12, and the mounting columns 22 are suitable for being fixed with fasteners. In this way, fixing sleeves 12 are fixed as well when the mounting columns 22 are fixed with fasteners, thus fixing the first air duct 1 and the second air duct 2 reliably. There are a plurality of fixing sleeve 12, and a plurality of fixing sleeves 12 are spaced circumferentially on the first end of the first air duct 1, and there are a plurality of mounting columns 22, the plurality of mounting columns 22 are spaced circumferentially on the first end of the second air duct 2, the plurality of fixing sleeves 12 correspond to the plurality of mounting columns 22 one by one.

Figure 3:
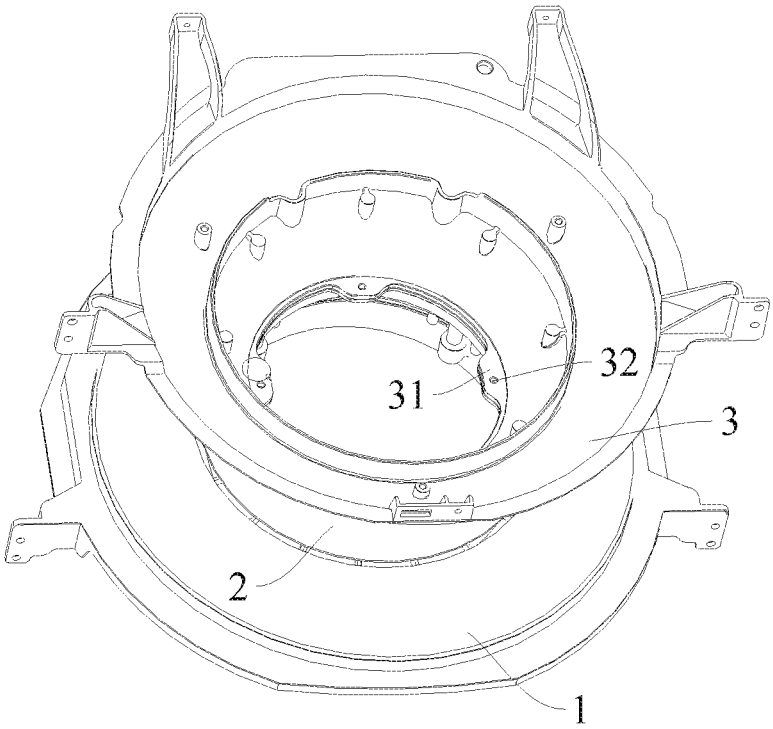
Figure 4:
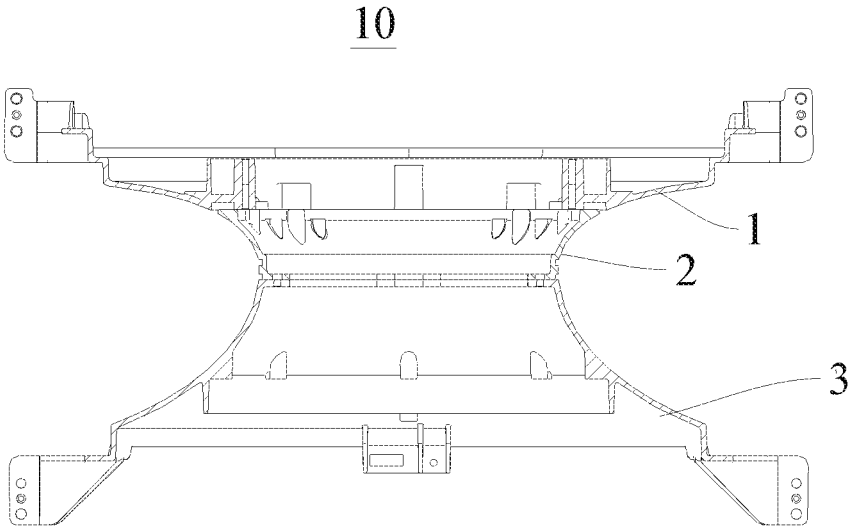
FIG. 4 is a sectional view of the middle air duct of the air conditioner according to embodiments of the present invention.

According to a specific embodiment of the present invention, as shown in FIG. 1 and FIG. 3, second mounting plates 23 are disposed on a second end of the second air duct 2, third mounting plates 31 are disposed on a first end of the third air duct 3, and the second mounting plates 23 are fixed with the third mounting plates 31. The fixation between the second mounting plates 23 and the third mounting plates 31 may make the second air duct 2 fixed with the third air duct 3 reliably and simply.

As shown in FIG. 1 and FIG. 3, there are a plurality of second mounting plates 23 and third mounting plates 31. Specifically, a plurality of second mounting plates 23 respectively bulge inward along circumference of the second end of the second air duct 2, a plurality of third mounting plates 31 respectively bulge inward along circumference of the first end of the third air duct 3. Thus, the second air duct 2 and the third air duct 3 are fixed reliably circumferentially.

Specifically, as shown in FIG. 3, the second mounting plates 23 and the third mounting plates 31 are provided with mounting holes 32 for fasteners to pass through successively. That is, on the corresponding group of the second mounting plates 23 and the third mounting plates 31, fasteners may pass through the mounting holes 32 on the above two mounting plates correspondingly, and then fix the two mounting plates, thus fixing the second air duct 2 and the third air duct 3 reliably more.

Further, as shown in FIG. 1 and FIG. 3, positioning holes 11 are arranged on at least one of the second mounting plates 23, positioning columns 21 are arranged on at least one of the third mounting plates 31, and the positioning columns 21 are suitable for stretching into the positioning holes 11. That is, based upon the configuration of the positioning holes 11, the second mounting plates 23 and the third mounting plates 31 may be mounted via the coordination between the positioning holes 11 and the positioning columns 21, thus playing a pre-positioning role, which achieves simple and reliable installation of the second mounting plates 23 and the third mounting plates 31.

Optionally, the first air duct 1, the second air duct 2 and the third air duct 3 are cast aluminum. On one hand, the cast aluminum has a simple and reliable structure and light weight, on the other hand, it has long service life.

An air conditioner according to embodiments of the present invention includes the middle air duct 10 of the air conditioner of the above embodiments.

In the description of the specification, terms "one embodiment", "some embodiments", "schematic embodiment", "example", or "specific example", or "some examples" and other description denote a specific feature, structure, material or characteristic described with reference to the embodiment or example, which are included in at least one embodiment or example of the present invention. In the specification, schematic expression of the above terms does not always refer to the same embodiment or example. Moreover, the specific feature, structure, material or characteristic described may be appropriately combined in any one or more embodiments or examples.

Although embodiments of the present invention have been indicated and described, it can be appreciated for those ordinary skill in the art that: various changes, modifications, substitutions and variations of these embodiments may be made within the principle and spirit of the present invention, and the scope of the present invention is limited by claims and equivalents thereof.

What is claimed is:

1. An air duct of an air conditioner, the air duct comprising:

a first air duct, a second air duct and a third air duct, wherein each of the first air duct, the second air duct and the third air duct comprises a duct structure having a first end and a second end, wherein the duct structure of the each of the first air duct, the second air duct and the third air duct are separable from each other, wherein for the each of the first air duct, the second air duct and the third air duct:

a cross sectional area of the first end is greater than a cross sectional area of the second end; and a plurality of cross sectional areas between the first end and the second end decrease progressively from the first end to the second end, wherein the first air duct, the second air duct and the third air duct are communicated successively in a predetermined direction such that the second end of the duct structure of the third air duct is arranged closer to the second end of the duct structure of the first air duct and further from the first end of the duct structure of the first air duct, wherein the second air duct further comprises a mounting column provided on the first end of the duct structure of the second air duct, wherein the first air duct further comprises a fixing sleeve provided on the second end of the duct structure of the first air duct, wherein the mounting column is configured to stretch into the fixing sleeve, and wherein the mounting column and the fixing sleeve are configured to receive a fastener to attach the first air duct to the second air duct.

2. The air duct according to claim 1, wherein the first air duct and the second air duct are communicated successively in the predetermined direction such that the first end of the duct structure of the second air duct is arranged closer to the second end of the duct structure of the first air duct and further from the first end of the duct structure of the first air duct.

3. The air duct according to claim 2, wherein the second air duct further comprises one of a positioning column and a positioning hole, provided on the first end of the duct structure of the second air duct, wherein the first air duct further comprises another of the positioning column and the positioning hole, provided on the second end of the duct structure of the first air duct, and wherein the positioning column is configured to extend into the positioning hole to position the first air duct and the second air duct relative to each other.

4. The air duct according to claim 1, wherein the second air duct further comprises one of a pair of mounting plates provided on the second end of the duct structure of the second air duct, wherein the third air duct further comprises another of the pair of mounting plates provided on the second end of the duct structure of the third air duct, and wherein the pair of mounting plates are fixed to each other to attach the second air duct to the third air duct.

5. The air duct according to claim 4, wherein the one of the pair of mounting plates bulge inwards along the circumference of the second end of the duct structure of the second air duct, wherein the other of the pair of mounting plates bulge inward along the circumference of the second end of the duct structure of the third air duct.

6. The air duct according to claim 4, wherein the pair of mounting plates are each provided with mounting holes, and wherein the mounting holes are configured to receive a fastener to pass through the mounting holes successively to attach the second air duct to the third air duct.

7. The air duct according to claim 6, wherein a first of the pair of mounting plates comprises a positioning hole, wherein a second of the pair of mounting plates comprises a positioning column configured to extend into the positioning hole to position the second air duct and the third air duct relative to each other.

8. The air duct according to claim 1, wherein each of the first air duct, the second air duct and the third air duct are formed of cast aluminum.

9. An air conditioner comprising:

the air duct according to claim 1;

a blower portion; and an air inlet portion, wherein the blower portion, the air inlet portion and the air duct are communicated successively in the predetermined direction.

10. An air duct of an air conditioner, the air duct comprising:

a first air duct, a second air duct and a third air duct, wherein each of the first air duct, the second air duct and the third air duct comprises a duct structure having a first end and a second end, wherein the duct structure of the each of the first air duct, the second air duct and the third air duct are separable from each other, wherein for the each of the first air duct, the second air duct and the third air duct:

a cross sectional area of the first end is greater than a cross sectional area of the second end; and a plurality of cross sectional areas between the first end and the second end decrease progressively from the first end to the second end, wherein the first air duct, the second air duct and the third air duct are communicated successively in a predetermined direction such that the second end of the duct structure of the third air duct is arranged closer to the second end of the duct structure of the first air duct and further from the first end of the duct structure of the first air duct, wherein the second air duct further comprises one of a pair of mounting plates provided on the second end of the duct structure of the second air duct, wherein the third air duct further comprises another of the pair of mounting plates provided on the second end of the duct structure of the third air duct, and wherein the pair of mounting plates are fixed to each other to attach the second air duct to the third air duct.

11. The air duct according to claim 10, wherein the first air duct and the second air duct are communicated successively in the predetermined direction such that the first end of the duct structure of the second air duct is arranged closer to the second end of the duct structure of the first air duct and further from the first end of the duct structure of the first air duct.

12. The air duct according to claim 11, wherein the second air duct further comprises one of a positioning column and a positioning hole, provided on the first end of the duct structure of the second air duct, wherein the first air duct further comprises another of the positioning column and the positioning hole, provided on the second end of the duct structure of the first air duct, and wherein the positioning column is configured to extend into the positioning hole to position the first air duct and the second air duct relative to each other.

13. The air duct according to claim 10, wherein the second air duct further comprises a mounting column provided on the first end of the duct structure of the second air duct, wherein the first air duct further comprises a fixing sleeve provided on the second end of the duct structure of the first air duct, wherein the mounting column is configured to stretch into the fixing sleeve, and wherein the mounting column and the fixing sleeve are configured to receive a fastener to attach the first air duct to the second air duct.

14. The air duct according to claim 10, wherein the one of the pair of mounting plates bulge inwards along the circumference of the second end of the duct structure of the second air duct, wherein the other of the pair of mounting plates bulge inward along the circumference of the second end of the duct structure of the third air duct.

15. The air duct according to claim 10, wherein the pair of mounting plates are each provided with mounting holes, and wherein the mounting holes are configured to receive a fastener to pass through the mounting holes successively to attach the second air duct to the third air duct.

16. The air duct according to claim 15, wherein a first of the pair of mounting plates comprises a positioning hole, wherein a second of the pair of mounting plates comprises a positioning column configured to extend into the positioning hole to position the second air duct and the third air duct relative to each other.

17. The air duct according to claim 10, wherein each of the first air duct, the second air duct and the third air duct are formed of cast aluminum.

18. An air conditioner comprising:

the air duct according to claim 10;

a blower portion; and an air inlet portion, wherein the blower portion, the air inlet portion and the air duct are communicated successively in the predetermined direction.

* * * * *